US006481049B1

(12) United States Patent
Berfield

(10) Patent No.: US 6,481,049 B1
(45) Date of Patent: Nov. 19, 2002

(54) SELF-EVACUATING VACUUM CLEANER

(75) Inventor: Robert C. Berfield, Jersey Shore, PA (US)

(73) Assignee: Shop Vac Corporation, Williamsport, PA (US)

( * ) Notice: Subject to any disclaimer, the term of this patent is extended or adjusted under 35 U.S.C. 154(b) by 1 days.

(21) Appl. No.: 09/589,492

(22) Filed: Jun. 7, 2000

(51) Int. Cl.[7] ..... A47L 7/00
(52) U.S. Cl. ..... 15/353; 96/406
(58) Field of Search ..... 15/320, 321, 353, 15/339; 96/406

(56) References Cited

U.S. PATENT DOCUMENTS

| | | | | | |
|---|---|---|---|---|---|
| 1,661,480 | A | | 3/1928 | Keefer | |
| 1,691,164 | A | | 11/1928 | Monk | |
| 1,982,345 | A | | 11/1934 | Kirby | |
| 2,292,435 | A | * | 8/1942 | Crites | 15/321 |
| 2,932,844 | A | * | 4/1960 | OConnor | 15/321 |
| 2,989,769 | A | * | 6/1961 | Houser | 15/353 |
| 3,173,164 | A | * | 3/1965 | Congdon | 15/314 |
| 4,080,104 | A | | 3/1978 | Brown, Jr. | |
| 4,179,768 | A | | 12/1979 | Sawyer | |
| 4,246,676 | A | | 1/1981 | Hallsworth et al. | |
| 4,723,337 | A | | 2/1988 | Ellison et al. | |
| 4,821,367 | A | * | 4/1989 | McAllister | 96/406 X |
| 5,287,590 | A | | 2/1994 | Yonkers et al. | |
| 5,349,722 | A | | 9/1994 | Chayer | |
| 5,465,455 | A | | 11/1995 | Allen | |
| 5,555,597 | A | | 9/1996 | Berfield | |
| 5,715,568 | A | | 2/1998 | Berfield et al. | |
| 5,850,668 | A | | 12/1998 | Berfield et al. | |
| 5,918,344 | A | | 7/1999 | Crevling, Jr. et al. | |
| 5,920,955 | A | | 7/1999 | Berfield | |
| 5,966,775 | A | | 10/1999 | Berfield | |
| 6,009,596 | A | | 1/2000 | Buss et al. | |
| 6,049,940 | A | | 4/2000 | Robitaille | |
| 6,069,330 | A | | 5/2000 | Crevling, Jr. et al. | |
| 6,079,076 | A | | 6/2000 | Berfield | |
| 6,112,366 | A | | 9/2000 | Berfield | |
| 6,119,304 | A | | 9/2000 | Berfield et al. | |

* cited by examiner

*Primary Examiner*—Chris K. Moore
(74) *Attorney, Agent, or Firm*—Marshall, Gerstein & Borun

(57) ABSTRACT

A vacuum cleaner has an electric motor driving an air impeller for creating a low pressure and a pump which draws liquid material through an inlet tube from the bottom of a tank and expels it from the tank. A priming apparatus is provided for priming the pump impeller. An outlet of the pump is connected to a discharge outlet carried by an upper vacuum assembly. Outlet piping connects the pump outlet to the discharge outlet. A pinch valve selectively closes the outlet piping to allow the priming apparatus to prime the pump. The pump and outlet piping are preferably carried by the upper vacuum assembly to facilitate conversion of the vacuum cleaner between wet and dry pick-up.

20 Claims, 10 Drawing Sheets

SELF-EVACUATING VACUUM CLEANER

FIELD OF THE INVENTION

The present invention relates to vacuum cleaners, and more particularly to wet/dry vacuum cleaners where liquid material in a tank of the vacuum cleaner is pumped out to waste.

BACKGROUND ART

Tank-type vacuum cleaners are capable of receiving dry materials such as debris or dirt and may also be used for suctioning liquids. When the tank is full, an upper vacuum assembly (which often includes a motor and an air impeller) is removed and the contents are dumped out. If the vacuum cleaner is used on liquid material, the tank, when at or near capacity, may be very heavy so that lifting the tank, to pour the contents into a sink or the like, is difficult. Even tilting the tank to pour the contents into a floor drain may be unwieldy when the liquid level in the tank is high.

One solution to the difficulties encountered in emptying liquid from vacuum tanks has been to provide an outlet at the bottom of the tank. Such a solution is satisfactory when the contents of the tank are emptied into a floor drain; however, if no floor or other low-placed drain is available the tank must be lifted to a sink or similar disposal site. In such cases the outlet at the bottom of the tank is of little value.

A second solution to emptying a vacuum tank of liquid is to provide a pump, usually with a motor located outside of or in the bottom of the tank. The pump removes liquid through a lower portion of the tank and expels it through a hose to waste. While such pumps are generally effective, they may be very costly. The pump requires not only a pump impeller and hoses but also its own electric motor, power cords, and switches. The expense of such items may be significant in the context of the overall cost of a vacuum cleaner, particularly those designed for residential use. Such pumps may also reduce the effective capacity of the vacuum tank or interfere with operation when the vacuum cleaner is used on dry materials. In addition, it may also be necessary to provide costly or complicated structures to prime the pump, if the pump is not located in the bottom of the tank.

Previous patents having a common assignee as the present application, such as U.S. Pat. No. 6,009,596, disclose a wet/dry vacuum cleaner having a self-priming pump for evacuating collected liquid. The devices disclosed and claimed therein provide significant improvements over the prior art. Certain aspects of the devices, however, have proven to be unnecessarily difficult or cumbersome. For example, the pump of the previous devices is provided in a split construction, in which an upper pump assembly is carried by an upper vacuum assembly and includes the pump impeller. A pump adapter assembly provides a lower portion of the pump, and is removably attached to the upper pump assembly. The pump adapter assembly defines a pump inlet and a pump outlet. To switch the vacuum cleaner from wet to dry pick-up, the upper vacuum assembly is removed from the tank and the pump adapter assembly is disconnected from the upper pump assembly. An outlet tube must also be disconnected from a discharge port before the pump adapter assembly may be completely removed from the tank.

In addition, the previous self-evacuating vacuum cleaners have employed priming apparatus which are overly difficult to actuate. In the '596 patent, for example, a ball valve is disposed in the pump outlet pipe for controlling when the pump is primed. The ball valve includes a knob which may be used to move the ball valve to a closed position, a partially open position, and a fully open position, depending on the operating conditions and desired outcome. Furthermore, the knob may be left accidentally in one of the positions, thereby leading to unintended operation of the pump during subsequent use. As a result, the previous devices are overly complicated and difficult to use.

SUMMARY OF THE INVENTION

In accordance with one aspect of the present invention, a vacuum cleaner is provided comprising a tank having an inlet for receiving liquid material, the tank defining an interior. An air impeller housing has an opening in air flow communication with the tank interior. A driven air impeller is disposed inside the air impeller housing and defines an interior impeller space. The air impeller creates a low pressure area in the tank interior and a lower pressure area at the interior impeller space. A pump housing has an inlet in fluid communication with the tank interior and an outlet, and a powered pump impeller is disposed inside the pump housing. Outlet piping extends between the pump outlet and the tank exterior, and includes a flexible tube section. A pinch valve is positioned to engage the flexible tube section, the pinch valve moving between a first position allowing fluid flow through the tube section, and a second position, which prevents fluid flow through the tube section.

In accordance with another aspect of the present invention, a vacuum cleaner comprises a tank having an inlet for receiving liquid material, the tank defining an interior. An upper vacuum assembly is releasably attached to the tank, the upper vacuum assembly including a discharge outlet. An air impeller housing is carried by the upper vacuum assembly and has an opening in air flow communication with the tank interior. A driven air impeller is disposed inside the air impeller housing and defines an interior impeller space, the air impeller creating a low pressure area in the tank interior and a lower pressure area at the interior impeller space. A pump housing is carried by the upper vacuum assembly and has an inlet in fluid communication with the tank interior and an outlet. A powered pump impeller is disposed inside the pump housing. A pump outlet pipe extends from the pump outlet to the discharge outlet, the pump outlet pipe remaining in place between the pump outlet and the discharge outlet when the upper vacuum assembly is removed from the tank.

In accordance with an additional aspect of the present invention, a vacuum cleaner comprises a tank having an inlet for receiving liquid material, the tank defining an interior. An upper vacuum assembly is releasably attached to the tank, the upper vacuum assembly including a discharge outlet. A lid cage is carried by the upper vacuum assembly and has a periphery defining a filter receiving portion and a non-filter receiving portion. An air impeller housing is carried by the upper vacuum assembly and has an opening in air flow communication with the tank interior. A driven air impeller is disposed inside the air impeller housing and defines an interior impeller space, the air impeller creating a low pressure area in the tank interior and a lower pressure area at the interior impeller space. A pump housing is carried by the upper vacuum assembly and has an inlet in fluid communication with the tank interior and an outlet disposed inside the lid cage. A powered pump impeller is disposed inside the pump housing. A pump outlet pipe extends from the pump outlet to the discharge outlet, the pump outlet pipe passing through the non-filter receiving portion of the lid cage.

In accordance with a further aspect of the present invention, a vacuum cleaner comprises a tank having an inlet for receiving liquid material, the tank defining an interior. An air impeller housing has an inlet in air flow communication with the tank interior, and an air impeller is disposed inside the air impeller housing. A motor is provided for driving the air impeller, and a switch is operably coupled to the motor. A center tube is disposed inside the tank. A float is provided having a guide extension portion sized to slidably engage an exterior of the center tube, and a liquid engaging portion. The float is positioned inside the tank so that the guide extension portion is disposed about the center tube. A float rod extends from the float to the switch. In operation, the float slides upwardly along the center tube as the liquid collects in the tank thereby to actuate the switch via the float rod.

Other features and advantages are inherent in the vacuum cleaner claimed and disclosed or will become apparent to those skilled in the art from the following detailed description in conjunction with the accompanying drawings.

DETAILED DESCRIPTION OF THE EMBODIMENT

Figure 1:
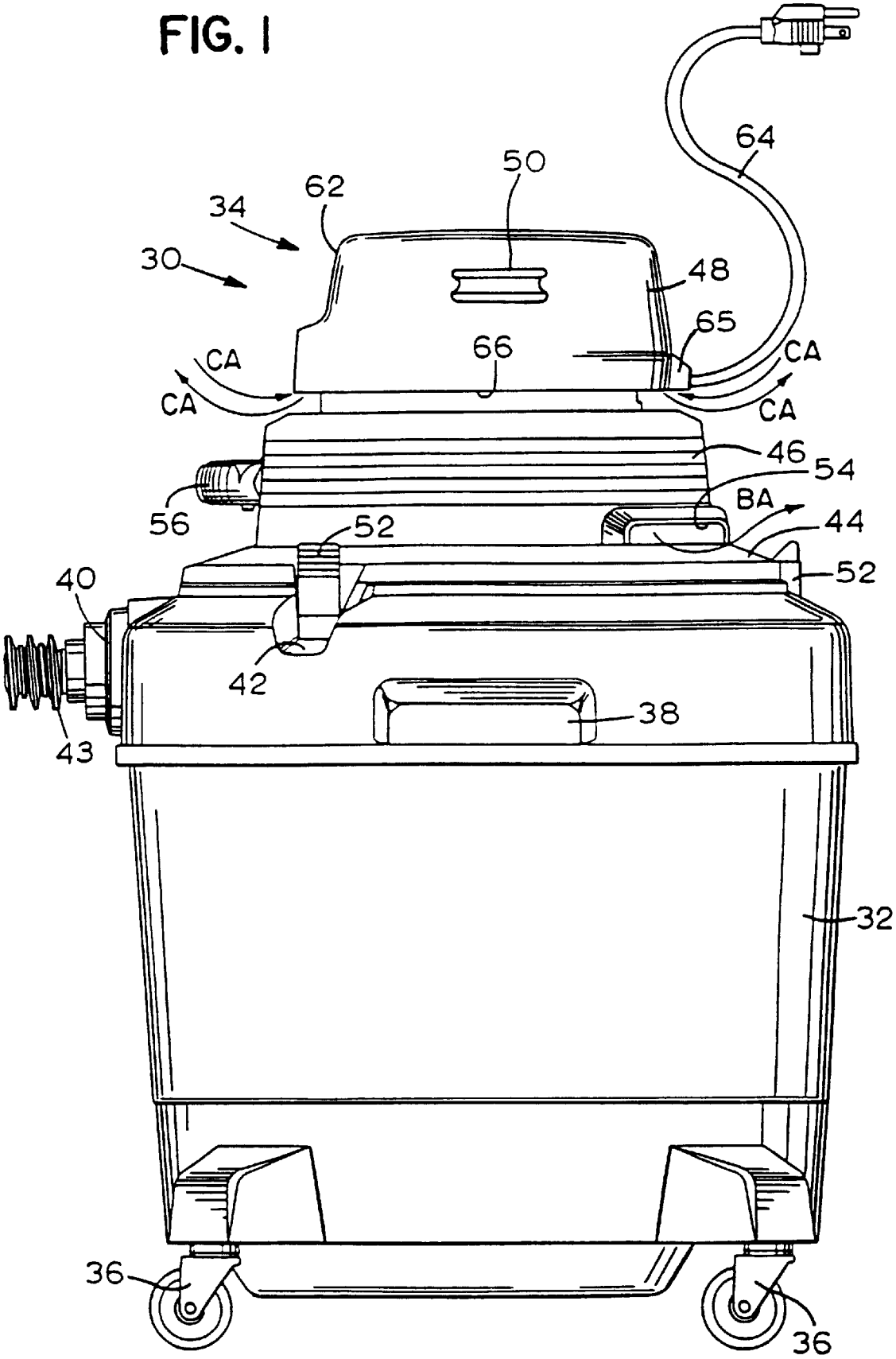
FIG. 1 is a side elevational view of a vacuum cleaner of the present invention.
Figure 2:
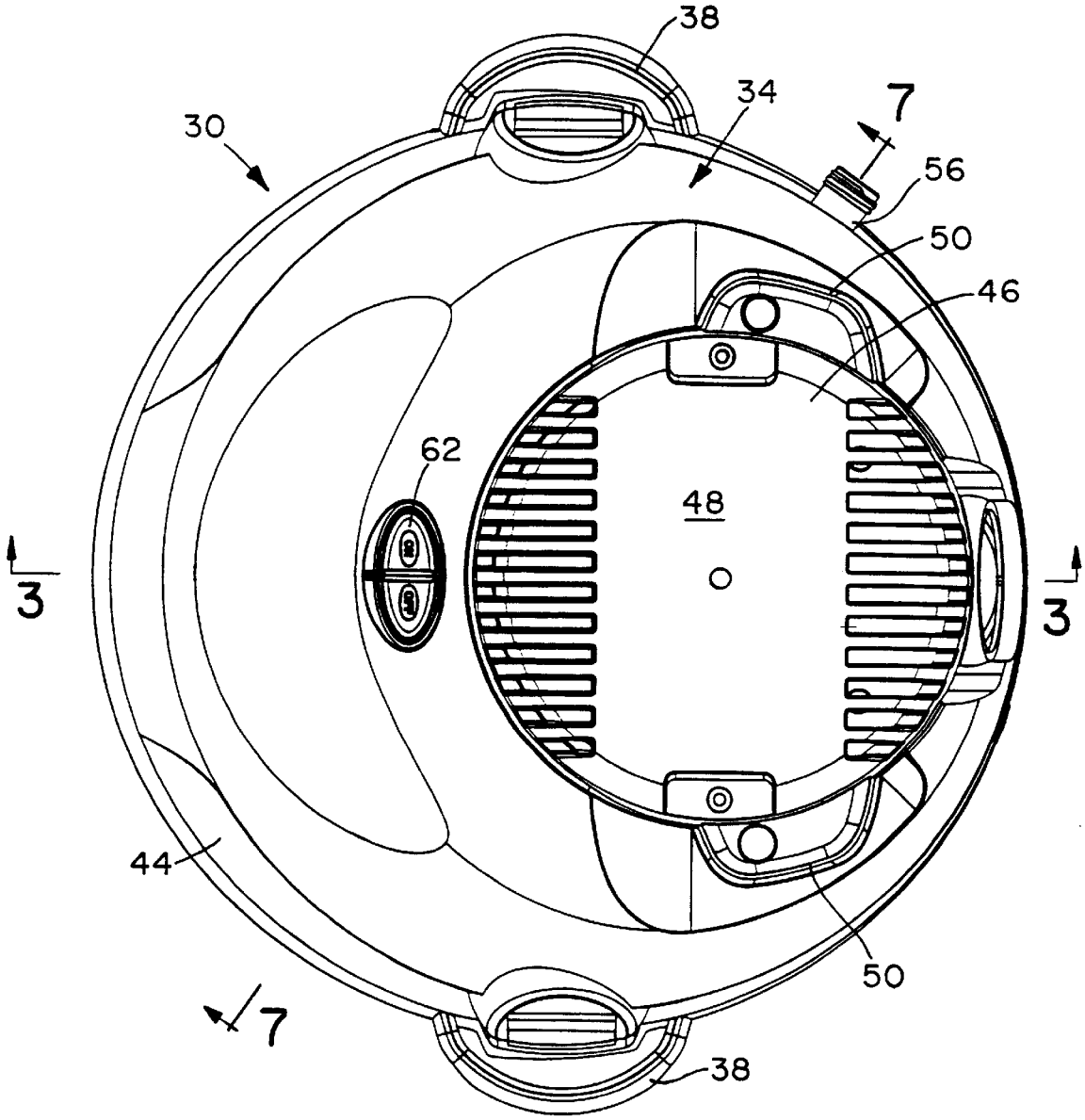
FIG. 2 is a top plan view of a vacuum cleaner of the present invention.

Referring initially to FIGS. 1 and 2, a vacuum cleaner of the present invention, indicated generally at 30, has a tank 32 and an upper vacuum assembly, indicated generally at 34. The tank 32 is supported by casters 36 and includes a pair of handles 38. The handles 38 may be used to assist the user in lifting and moving the vacuum cleaner 30. The tank 32 further defines a vacuum inlet 40 and a number of latch recesses 42. The vacuum inlet 40 may be fitted with a vacuum hose 43 for applying suction at desired locations.

The tank 32 supports the upper vacuum assembly 34. The upper vacuum assembly 34 includes a lid 44, a motor housing 46, a cover 48 and a pair of handles 50. The upper vacuum assembly 34 may be of conventional construction. Except as described below, the upper vacuum assembly 34 and its associated components may be similar to a Shop Vac Model QL20ATS vacuum cleaner as manufactured by Shop Vac Corporation of Williamsport, Pa. The lid 44 makes up the bottom of the upper vacuum assembly 34 and carries one or more latches 52. The motor housing 46 is connected to the top of the lid 44. The cover 48, in turn, is connected to the top of the motor housing 46, and finally, the handles 50 are attached to the motor housing 46. When a user wishes to connect the upper vacuum assembly 34 to the tank 32, the user lifts the upper vacuum assembly 34 above the tank 32, aligns the latches 52 with the latch recesses 42, lowers the upper vacuum assembly 34 until the lid 44 rests on top of the tank 32, and then, fastens the latches 52 to the tank 32.

The motor housing 46 defines multiple blower air discharge slots 54. Air drawn into the vacuum cleaner 30 by the inlet 40 is expelled through the blower air discharge slots 54 as shown by the arrow BA in FIG. 1. The motor housing 46 also has a vacuum cleaner discharge outlet 56. The cover 48 of the upper vacuum assembly 34 provides a housing for a switch actuation assembly 60 (FIG. 3) which includes a user engageable actuator 62 (FIG. 2). Extending outward from the cover 48 is an electric cord 64 (FIG. 1) which passes through a relief 65 formed in the cover 48. The motor housing 46 and the cover 48 may be formed as two separate, detachable pieces or as one piece, integral with one another. With either construction, the motor housing 46 and the cover 48 define an air passage 66 which allows air to enter and exit the cover 48, as shown by the arrows CA in FIG. 1.

Figure 3:
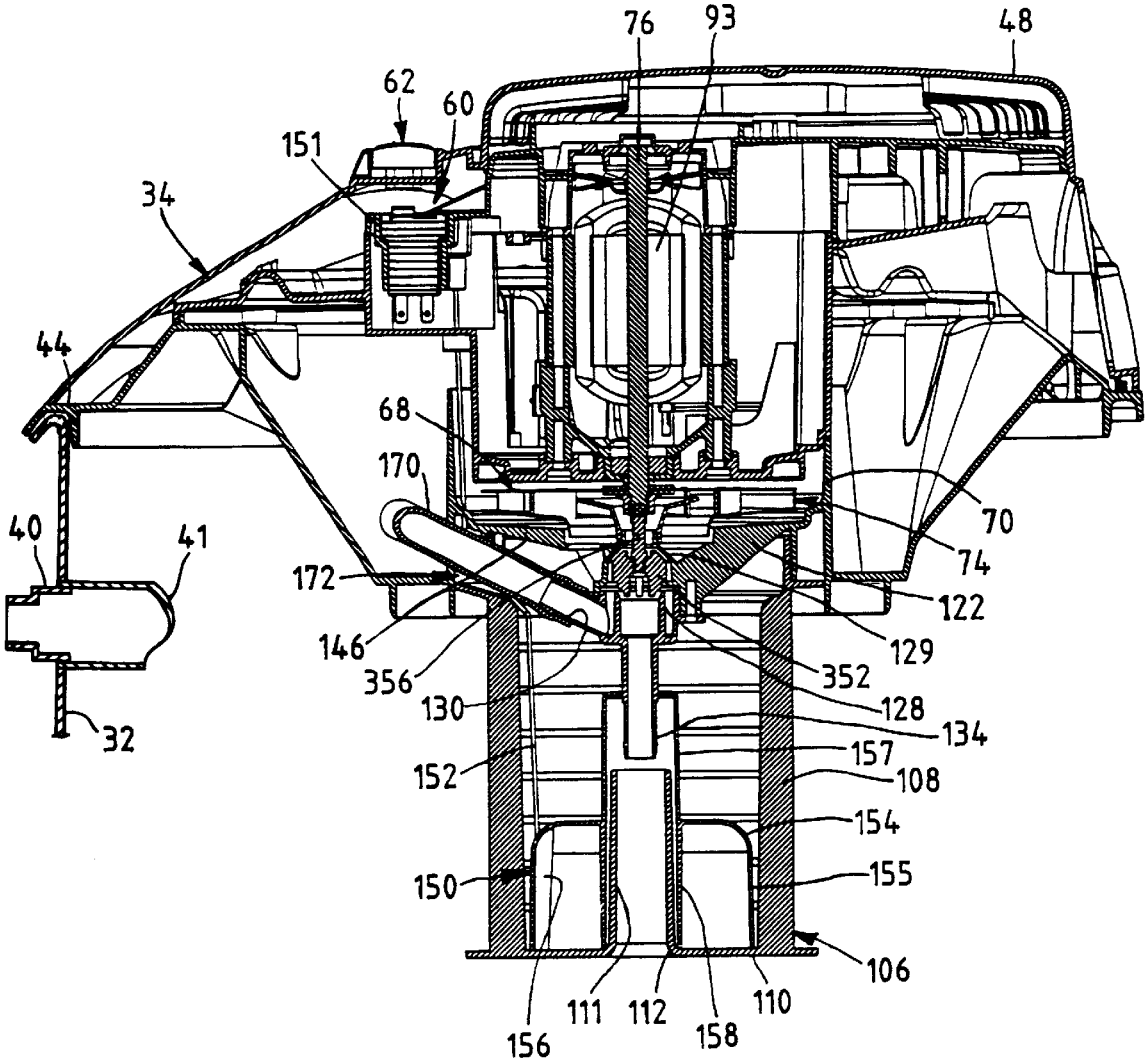
FIG. 3 is a side elevational view taken along the line 3—3 in FIG. 2.

Referring now to FIG. 3, a lid cage 106 is formed integral with the lid 44 of the upper vacuum assembly 34 and extends downward therefrom into the interior of the tank 32. Disposed within the combination of the lid cage 106 and the upper vacuum assembly 34 is, among other things, a motor 93 and a motor shaft 76. The motor shaft 76 is in engageable contact with an air impeller 74 of an air impeller assembly 68. A shaft extension 356 connects an end of the motor shaft 76 to a pump impeller 352 disposed inside a pump housing 129, as described in greater detail below.

Figure 5:
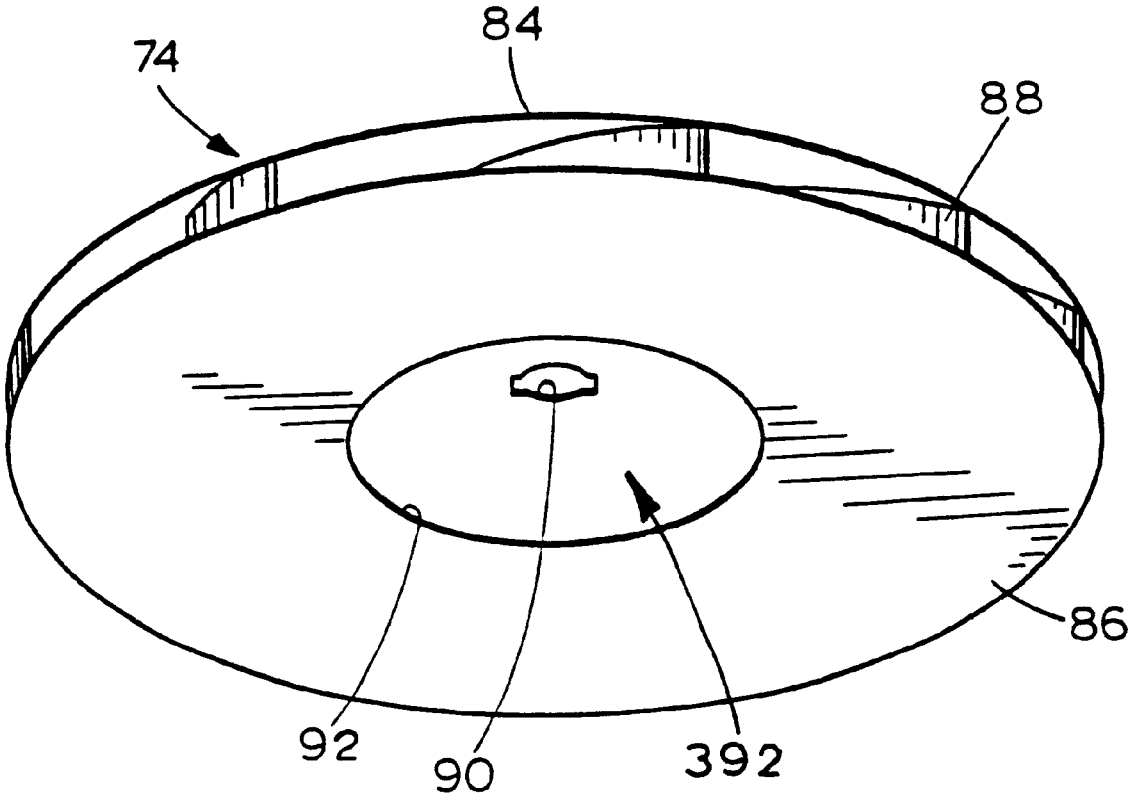
FIG. 5 is a perspective view of an air impeller of the present invention.
Figure 9:
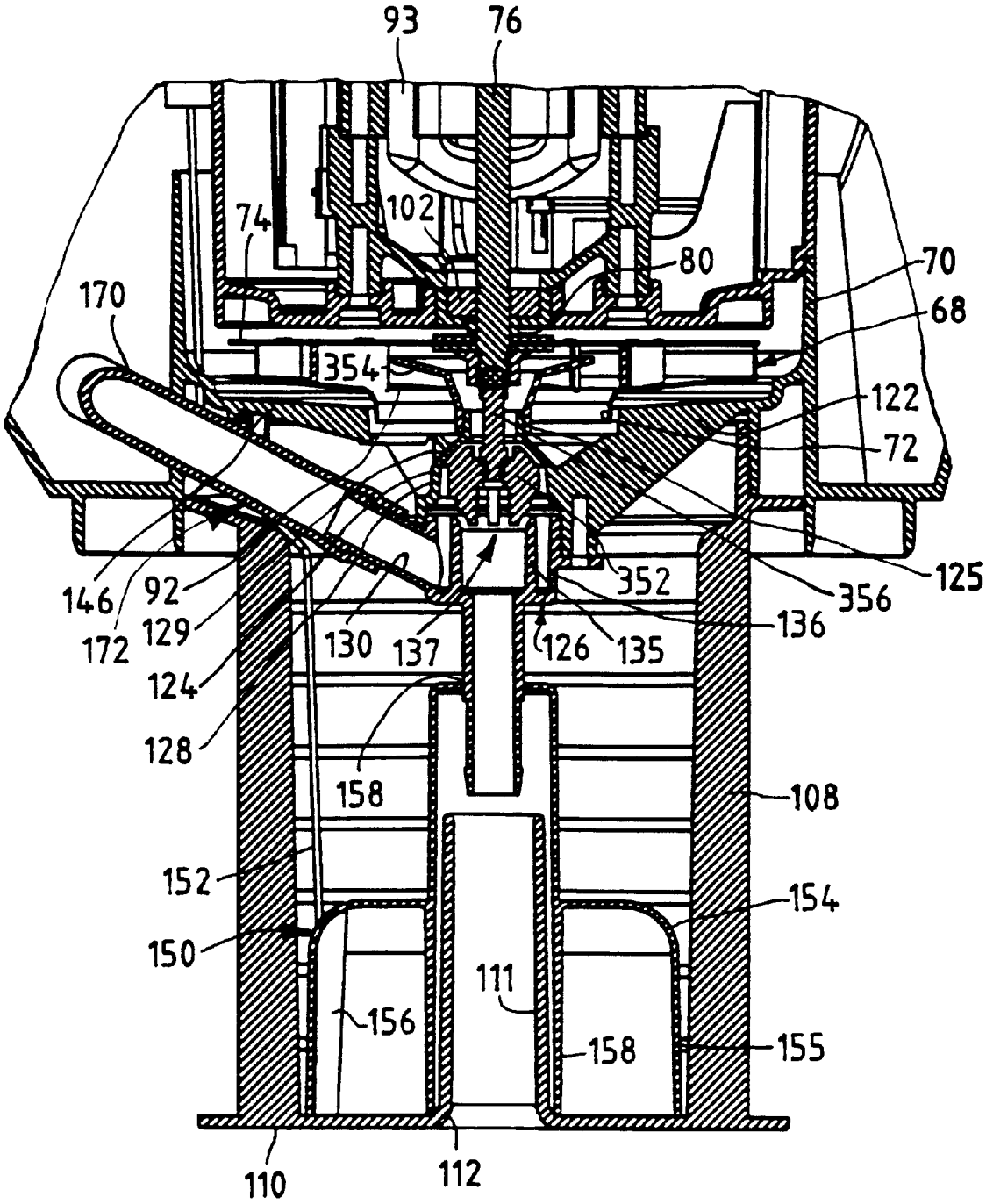
FIG. 9 is an enlarged view of a pump of FIG. 3.

Referring to FIGS. 3 and 9, the air impeller assembly 68 includes an air impeller housing 70, and the air impeller 74 suspended within the housing 70 by the motor shaft 76. While only one air impeller 74 is shown in the illustrated embodiment, multiple air impellers may be used in the vacuum cleaner 30. As illustrated in FIG. 5, the air impeller 74 includes a series of blades 88 disposed between an upper plate 84 and a lower plate 86. An interior impeller space 392 is defined near a center of the impeller 74. A notched opening 90 is formed in the upper plate 84, while an enlarged opening 92 is formed in the lower plate 86.

Figure 4:
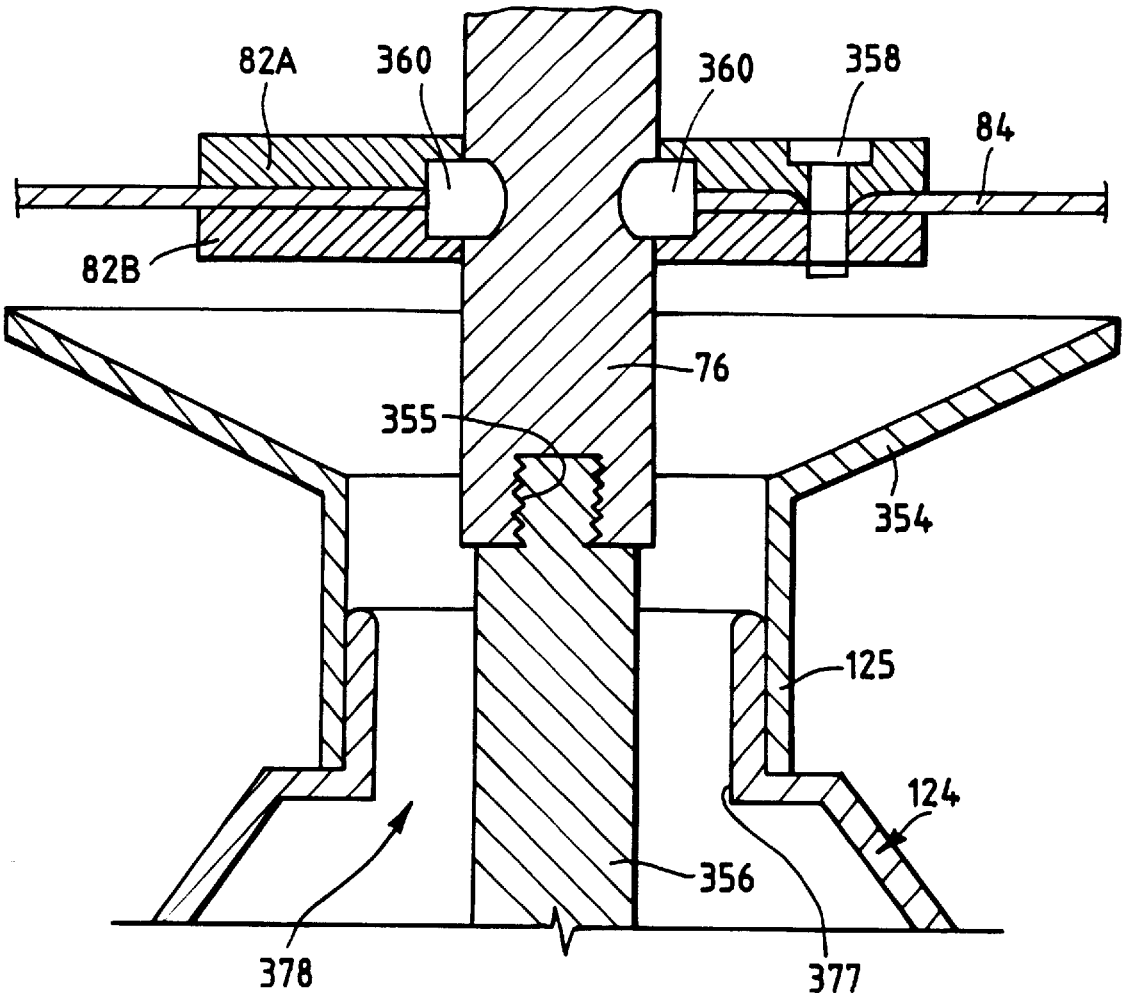
FIG. 4 is a partial view, in section, of an upper portion of priming apparatus.

As best shown in FIGS. 4 and 9, the motor shaft 76 extends from the motor 93, passes through a separation sleeve 80, an upper washer 82A, the notched opening 90, and a lower washer 82B. The motor shaft 76 further includes a socket 355 into which the shaft extension 356 is threadedly secured. The separation sleeve 80 and the upper washer 82A are disposed between the upper plate 84 and a motor bearing 102 (FIG. 9), and the lower washer 82B is disposed between the upper plate 84 and the shaft extension 356. The washers 82A, 82B are secured in place by a series of rivets 358 that are pressed into the upper washer 82A, the upper plate 84 and the lower washer 82B. The washers 82A, 82B act to stabilize the air impeller 74 during operation. The upper washer 82A, the upper plate 84 and the lower washer 82B are notched around the opening 90 of the upper plate 84 to receive a pair of swages 360 formed integral with the motor shaft 76 that extend outward therefrom. In operation, the swages 360 engage the upper plate 84 of the air impeller 74 to rotate the air impeller 74 with the motor shaft 76.

The vacuum inlet 40 preferably includes a vacuum director 41 for directing incoming waste material into the tank 32. As shown in FIG. 3, the vacuum director 41 is oriented so that vacuumed waste is directed downwardly toward a bottom of the tank 32. The orientation of the vacuum director is preferably adjustable, so that the director may also be pointed upwards. The illustrated downward direction is preferable for dry pick-up, so that the dry material projects into the bottom of the tank 32. For wet pick-up, the vacuum director 41 is preferably pointed upward to avoid excessive splashing of incoming liquid with liquid already collected in the tank 32. Excessive splashing may generate foam. In addition, splashing causes the air flow to be entrained with liquid particles which may be pulled into the air impeller 74 and motor 93.

Referring to FIG. 4, the shaft extension 356, is threadedly attached to the motor shaft 76, extends from the flat washer 82B through an opening 92 (FIG. 9) formed in the lower plate 86 of the air impeller 74, through an opening 72 formed in the air impeller housing 70, and, eventually, threads into the pump impeller 352 disposed in the pump housing 129.

The pump housing 129 includes an upper housing portion 124 having a collar 125 extending therefrom (FIG. 4). According to the illustrated embodiment, a vacuum director 354 is attached (e.g., press-fit, ultrasonically welded, etc.) to the collar 125 and extends from the collar 125 and through the enlarged opening 92 to the interior impeller space 392. The vacuum director 354 may alternatively be formed integrally with the collar 125 and upper housing portion 124. In either event, since the vacuum director 354 is attached to the stationary upper impeller housing 124, it does not rotate with the motor shaft 76.

The vacuum director 354 defines an air flow path between the interior impeller space 392 and the interior of the collar 125, the air flow path being defined by the space 378 (FIG. 4) between the shaft extension 356 and an interior of the collar 125. According to the illustrated embodiment, the space 378 has a generally annular cross section. As illustrated in FIG. 4, the vacuum director 354 is positioned so that a top edge is spaced from the upper plate 84 of the air impeller 74 to allow fluid communication between the interior impeller space 392 and the collar 125.

The interior of the vacuum director 354 also fluidly communicates with an interior of the pump housing 129 through a priming orifice 377 (FIG. 4) formed in the housing 129. As a result, a continuous, uninterrupted flow path is formed from the air impeller interior space 392 to the interior of the pump housing 129.

Figure 6A:
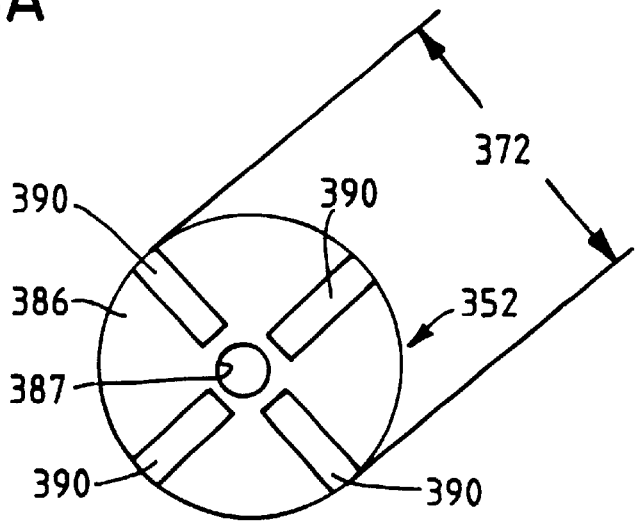
FIG. 6A is a top view of a pump impeller of the present invention.
Figure 6B:
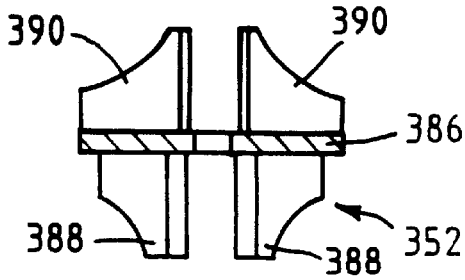
FIG. 6B is a side sectional view of the pump impeller.
Figure 6C:
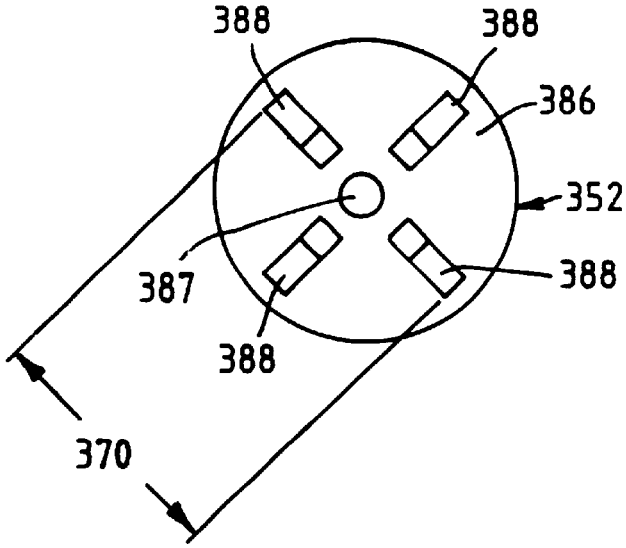
FIG. 6C is a bottom view of the pump impeller.

Referring to FIGS. 6A–6C, the pump impeller 352 is shown in greater detail. The pump impeller 352, which is preferably made of nylon 6, includes a base plate 386 having a threaded aperture 387 which is fastened to an end of the shaft extension 356, securing the pump impeller 352 inside the pump chamber 129. Formed integral with the base plate 386 and extending downward therefrom are a first set of four impeller blades 388. Formed integral with the base plate 386 and extending upward therefrom are a second set of four impeller blades 390. The exact number and configuration of the first and second sets of impeller blades 388, 390 is not critical. In the preferred embodiment, however, each blade 388, 390 is aligned axially with respect to the shaft extension 356. As a result, outside edges of the first set of impeller blades form an outside diameter 370, while outside edges of the second set of impeller blades also form an outside diameter 372. In a preferred embodiment, the outside diameter 372 of the second set is greater than the outside diameter 370 of the first set, as explained in greater detail below. The first and second sets of impeller blades 388, 390 rotate simultaneously with the shaft extension 356.

In the illustrated embodiment, the upper vacuum assembly 34 includes a pump mount portion 122 which connects the pump housing 129 to the air impeller housing 70. As detailed in FIG. 9, the pump housing 129 includes the upper housing portion 124 which is formed integrally with the pump mount 122; a lower housing portion 126 which, in this embodiment, is fixedly attached to the upper housing portion 124; and the pump impeller 352 which, as described above, is connected to the shaft extension 356. The upper pump housing 124 and lower pump housing 126 together form the complete pump housing 129. The shaft extension 356 keeps the pump impeller 352 suspended in the pump housing 129 between the upper and lower housing portions 124, 126 allowing the pump impeller 352 to rotate freely therein. The upper and lower housing portions 124, 126 are preferably made from polypropylene.

Referring now to FIG. 9, the lower housing portion 126 defines an inner chamber wall 135, an outlet sidewall 136 and an inlet stub tube 134. The inner chamber wall 135 combines with the upper housing portion 124 to define an interior pump chamber 137. The outlet sidewall 136 is generally concentric with and disposed radially outwardly of the inner chamber wall 135, and defines a pump outlet 130. The inlet stub tube 134 extends downwardly from the outlet sidewall 136 towards the tank 32. When the lower housing portion 126 is fixedly attached to the upper housing portion 124 as noted above, it will be appreciated that the pump outlet 130 is carried by the upper vacuum assembly 34.

Referring again to FIG. 3, the lid cage 106 includes several braces 108 that support a bottom plate 110. The bottom plate 110 defines an opening 112. As is generally known in the art, a removable filter and/or a removable filter cartridge having one or more filter media may be fitted about the circumference of the lid cage 106. The lid cage 106 also encloses an air impeller protection cage 146. The air impeller protection cage 146 extends inwardly from the lid cage 106 and around the pump mount portion 122. The protection cage 146 acts to keep large debris out of the air impeller assembly 68 to prevent such debris from interfering with the operation of the air impeller 74 while allowing air to flow between the air impeller assembly 68 and the tank 32.

The upper vacuum assembly 34 also houses a mechanical shut-off and override assembly indicated generally at 150. The mechanical shut-off and override assembly 150 includes the aforementioned switch actuation assembly 60, a switch 151, a float rod 152 and a float 154. The mechanical shut-off and override assembly 150 may be of any conventional design or may be of the type disclosed and claimed in commonly owned U.S. Pat. No. 5,918,344, incorporated herein by reference. In this embodiment, the switch actuation assembly 60 and the switch 151 are located in the cover 48, and the float 154 rests on the bottom plate 110 of the lid cage 106. The switch 151 controls the power to the motor 93 and has an "ON" and "OFF" position. The switch 151 is linked to the user engageable actuator 62 and to the float 154. The float 154 generally comprises a lower, fluid engaging portion 155, and a guide extension 157 having an aperture 158 sized to slidingly engage the inlet stub tube 134. The lid cage bottom plate 110 preferably includes a collar 111 extending upwardly toward the pump housing 129. The collar 111 has an inside diameter defining the opening 112, and an outer diameter. The fluid engaging portion 155 of the float 154 includes an inner sleeve 158 sized for insertion over the collar 111. The float 154 is hollow and may be made of any suitable material, such as copolymer polypropylene. The float 154 defines a rod receptacle 156 in which the float rod 152 sits. The float rod 152 extends upward from the float 154 and passes through the lid 44 and the motor housing 46, providing the linkage between the switch 151 and the float 154.

The illustrated float 154 advantageously simplifies assembly of the vacuum cleaner 30, and is retained in position after assembly. Before the lid cage 106 is attached to the upper vacuum assembly 34, the guide extension 157 may be placed over the inlet stub tube 134. The inlet stub tube 134 holds the float 154 in place as the lid cage 106 is attached. Once the lid cage 106 is in place, the float 154 is trapped between the bottom plate 110 and the bottom of the pump housing 129.

Figure 7A:
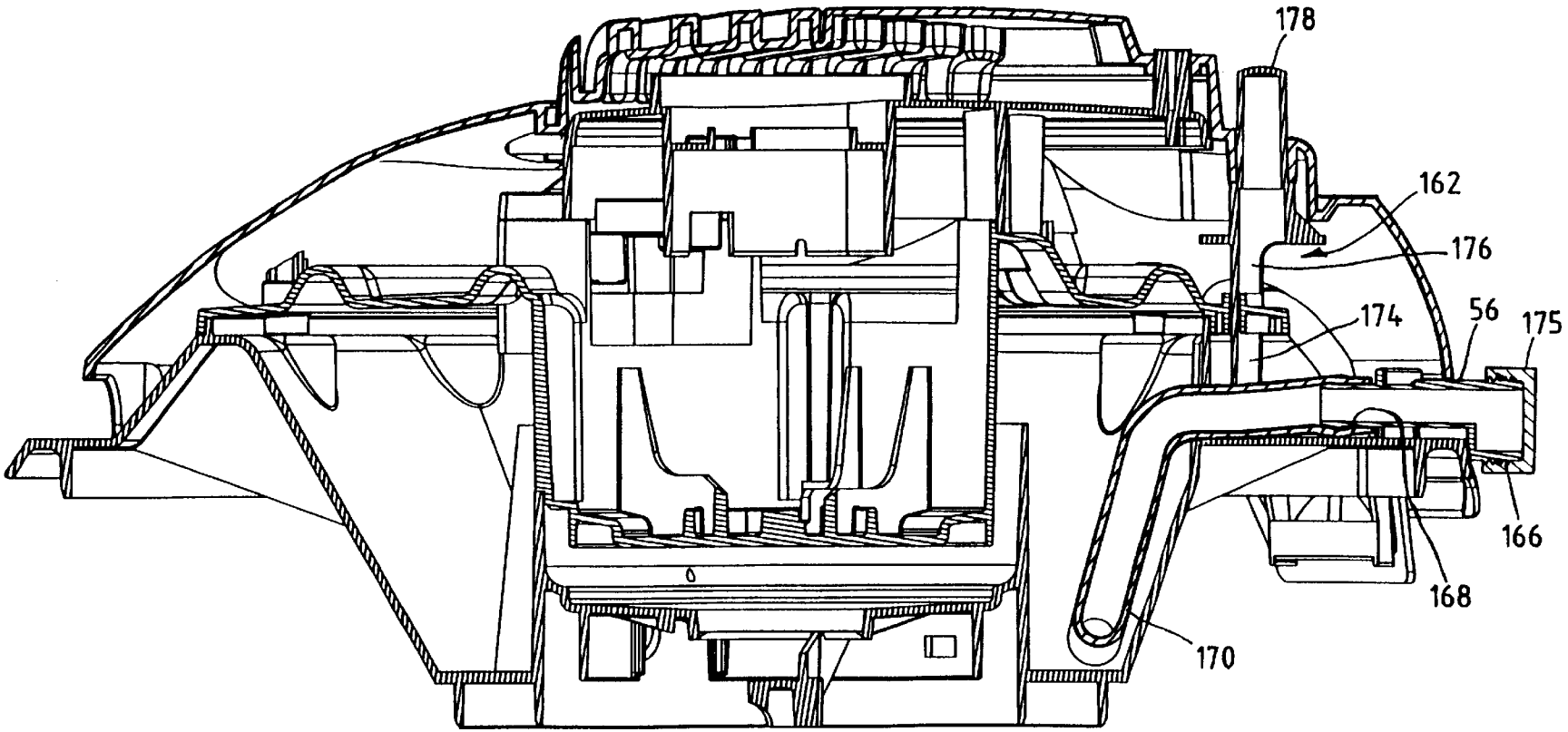
FIG. 7A is an enlarged side sectional view of an upper vacuum assembly showing a pinch valve in a first position.
Figure 7B:
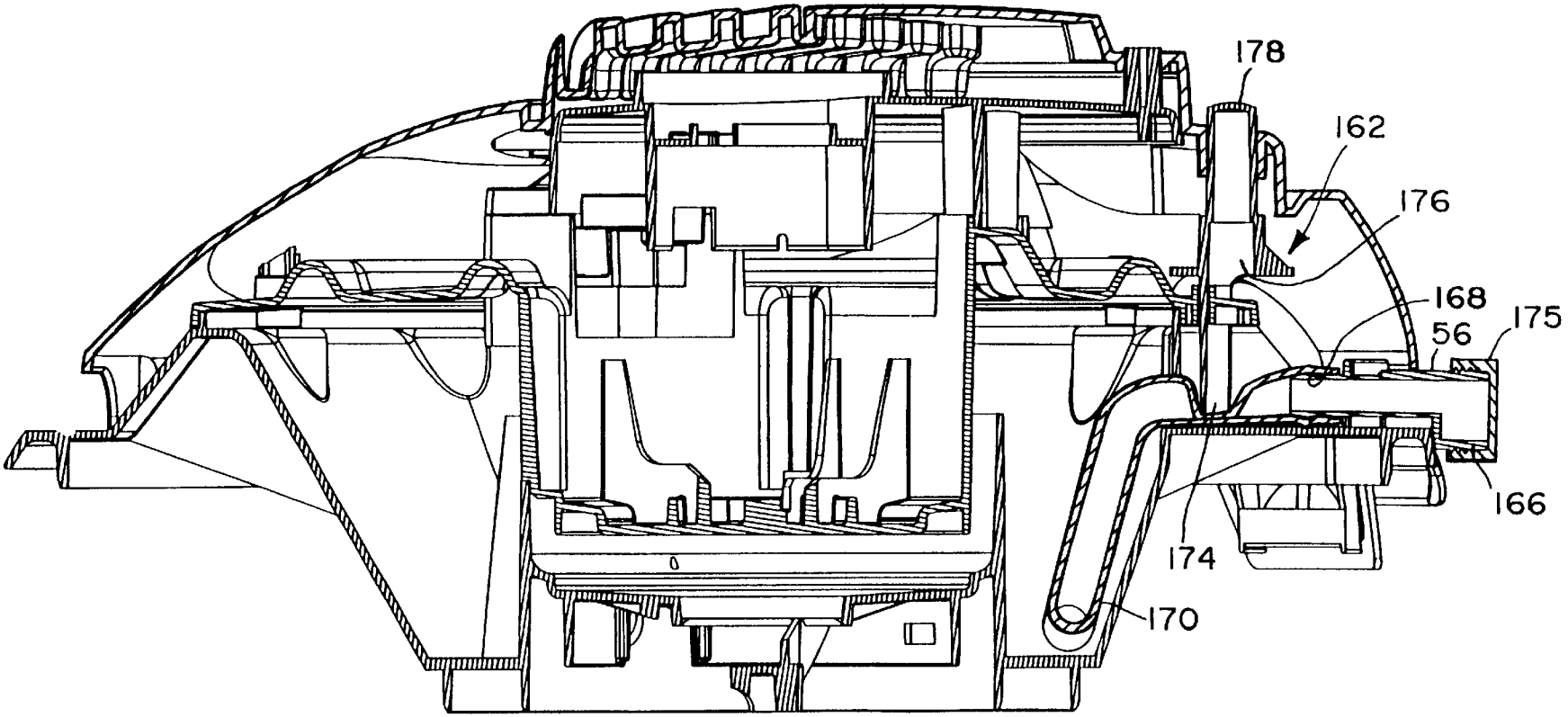
FIG. 7B is an enlarged side sectional view of an upper vacuum assembly showing a pinch valve in a second position.

Also housed in the upper vacuum assembly 34 is a priming and discharge assembly 162. Referring to FIGS. 7A and 7B, the priming and discharge assembly 162 includes the discharge outlet 56 and a pinch valve member 174. The discharge outlet 56 includes a threaded outlet end 166 and a connection end 168 disposed inside the upper vacuum assembly 34. A cap 175 is inserted over the outlet end 166 during dry and wet (without liquid pumping) pick-up. Outlet piping, in the form of a flexible tube 170, connects the connection end 170 to the pump outlet 130. An opening 172 (FIG. 9) is provided in the lid cage 106 through which the flexible tube 170 may pass. The movable pinch valve member 174 is positioned to engage a portion of the flexible tube 170. The pinch valve member 174 is movable between an open position (FIG. 7A), in which fluid flow through the tube 170 is uninterrupted, and a closed position (FIG. 7B), in which the pinch valve member 174 compresses one side of the tube 170 against an opposite side thereby to cut off flow through the tube. An extension arm 176 connects the pinch valve member 174 to a priming button 178 extending outside the upper vacuum assembly. The priming button 178 may be depressed to move the pinch valve member 174 from the open position to the closed position. When the priming button 178 is released, the pinch valve member 174 preferably automatically returns to the open position due to a return mechanism (not shown) or the structural force of the tube 170.

In operation, the pinch valve member 174 is normally in the open position during both wet and dry pick-up. During dry pick-up, the cap 175 closes off a potential unfiltered air flow passage into air impeller 74. During operation, the air impeller 74 creates a vacuum which draws air through the tank inlet 40. This same vacuum could also draw air through the discharge outlet 56. The cap 175 is preferably air tight to prevent air from entering the vacuum cleaner 30 through the discharge outlet 56 during dry pick-up. The same situation is prevented during wet pick-up. In addition, it will be appreciated that the pump 128 may prime unintentionally. The cap 175, therefore, also prevents liquid from flowing out the discharge outlet 56 during wet pick-up.

Figure 8:
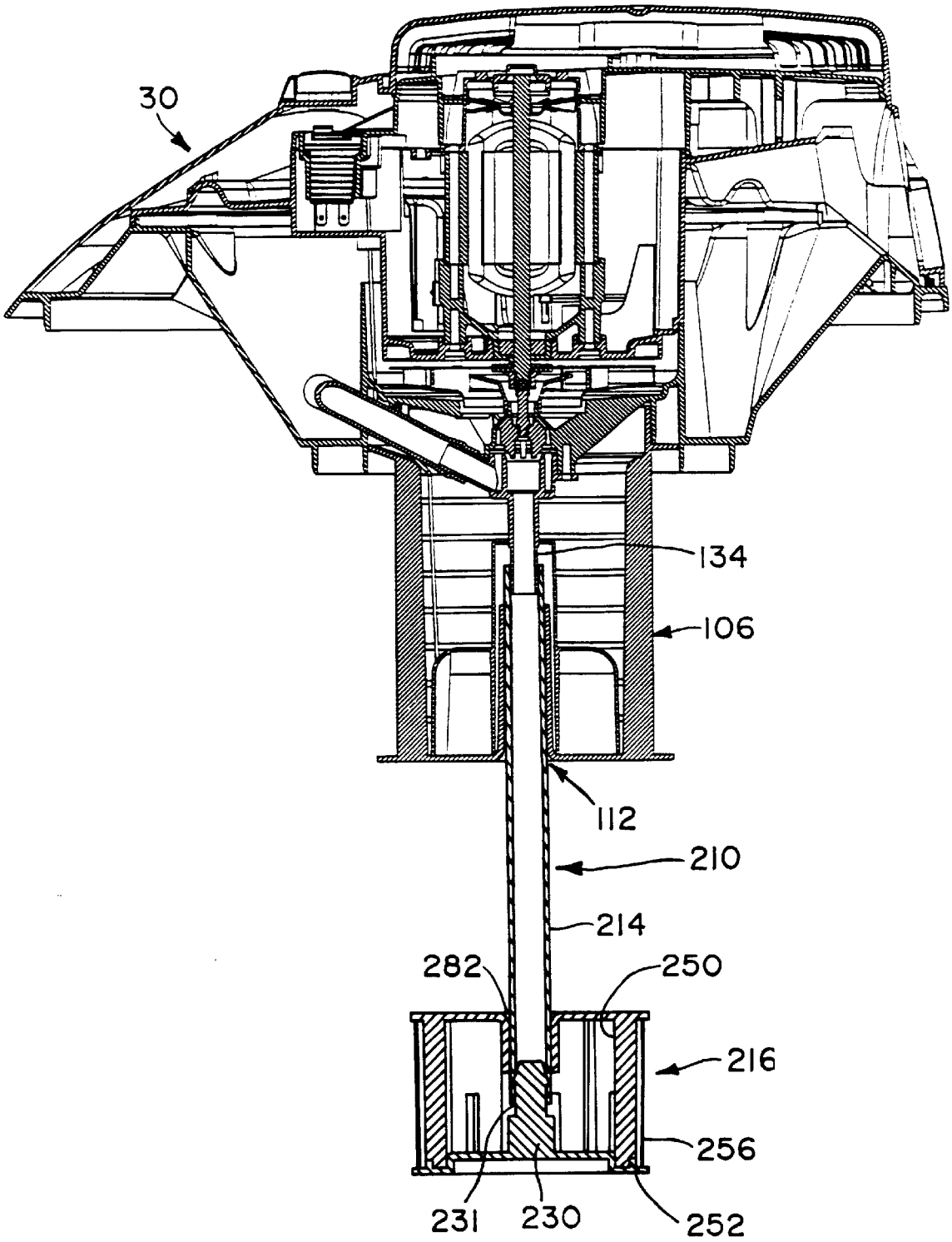
FIG. 8 is a view similar to FIG. 3 with a pump adapter assembly attached to a pump inlet.

FIG. 8 illustrates the vacuum cleaner 30 with a pump inlet assembly 210 installed. The pump inlet assembly 210 includes a pump inlet tube 214 and a liquid intake assembly 216. The pump inlet tube 214 is inserted through the opening 112, formed in the bottom plate 110 of the lid cage 106, and over the pump inlet stub tube 134. The attached pump inlet tube 214 establishes a piped connection between the inlet stub tube 134 and a lower portion of the tank 32.

Referring again to FIG. 8, one end of the pump inlet tube 214 fits onto the inlet stub tube 134. The other end of the inlet tube 214 is inserted over a fitting 230 formed in the liquid intake assembly 216. The liquid intake assembly 216 has an upper housing piece 250 defining a hollow body. A bottom of the upper housing piece 250 is closed by a plate 252. A screen 256 is disposed around the upper housing piece 250. The fitting 230 is formed with and projects upwardly from the bottom plate 252, and has barbs for frictionally securing an inlet portion 231 of the inlet tube 214 in place. Also formed in the top of the upper housing piece 250 is an opening 282 sized to receive the inlet tube 214. A liquid inlet opening (not shown) formed in the upper housing piece 250 provides fluid communication between the interior of the hollow body and the tank 32.

The vacuum cleaner 30 may be operated in three modes: dry vacuuming mode, wet vacuuming mode and pumping mode. FIG. 3 shows the vacuum cleaner 30 in dry vacuuming mode configuration. In dry vacuuming mode configuration, the pinch valve member 174 is in the open position and the cap 175 is attached to the discharge outlet 56. To convert the vacuum cleaner 30 to wet vacuuming mode configuration (without pumping liquid from the tank 32), the pinch valve member 174 remains in the open position and the cap 175 remains on the discharge outlet 56. To operate the vacuum cleaner 30 in either dry or wet vacuuming mode, the user engages the actuator 62 and turns the motor 93 on. The operating motor 93 turns the air impeller 74, via the motor shaft 76, in the air impeller housing 70 which creates a vacuum in the tank 32. The user is now able to vacuum materials into the tank 32. When the user is finished vacuuming or the tank 32 is full, the user can stop vacuuming by engaging the actuator 62 to turn the motor 93 off. If, while in wet vacuuming mode, the level of liquid in the tank 32 gets too high, the mechanical shut-off assembly 150 will automatically shut off the motor 93.

To convert the vacuum cleaner 30 to pumping mode, the pump inlet assembly 210 is installed (FIG. 8). To install the pump inlet assembly 210, the user inserts the inlet tube 214 of the pump inlet assembly 210 through the opening 112 in the lid cage bottom plate 110 and over the inlet stub tube 134. The dimension of each of the parts of the pump 128 will be dependent on the desired flow rate of the pump 128. In addition, the power of the motor 93 may also affect the size and design of many of the components, including the pump impeller 352. The pump outlet 130 is permanently connected to the discharge outlet 56 and housed within the upper vacuum assembly 34, and therefore a second outlet connection need not be made.

If the user desires to filter large particulates out of the material being drawn into the vacuum cleaner 30, the user may install a mesh collection bag (not shown) in the tank 32 and connect the bag to the inlet 40. The mesh collection bag may be of the type disclosed and claimed in U.S. patent application Ser. No. 08/903,635. Once the pump inlet assembly 210 is installed, and if desired, any collection bags, the user inserts the combined upper vacuum assembly 34/pump inlet assembly 210 into the tank 32 and then secures the lid 44 to the tank 32 with the latches 52.

The vacuum cleaner 30 may also be operated in combined wet vacuuming and pumping mode. For pumping mode, the cap 175 is removed from the discharge outlet 56 and a conduit, such as a garden hose, may be attached thereto. Referring to FIGS. 8 and 9, the user then turns the motor 93 "ON" by engaging the actuator 62. The now energized motor 93 simultaneously turns the air impeller 74 and the pump impeller 352 via the motor shaft 76/shaft extension 356 combination. The air impeller 74, rotating in the housing 70, reduces the pressure in the tank 32, creating a vacuum. The vacuum created in the tank 32 draws air, liquid and/or other material into the tank 32 through the vacuum hose 43 and the inlet 40. As noted above, the vacuum also creates suction flow through the discharge outlet 56.

If a mesh collection bag (not shown) is in place around the inlet 40, the mesh collection bag will filter out the exceptionally large particulates being vacuumed into the tank 32 and will reduce the possibility of the pump 128 getting clogged. Even if the pump 128 is not being used, the mesh collection bag could still be used to filter large particulates out from the liquid being collected in the tank 32 so that when the tank 32 is poured or emptied into a drain, the large particulates will not clog the drain. The air that is drawn into the tank 32 passes through the lid cage 106 (and any filters attached thereto), into the motor housing 46, and ultimately is expelled out of the discharge slots 54.

The rotating air impeller 74 further creates a low pressure area in the interior impeller space 392 such that the interior impeller space 392 is at a relatively lower pressure than the vacuum in the tank 32. While the relatively lower pressure is communicated to the pump housing via the vacuum director 354, the incoming air flow through the discharge outlet 56 is at a relatively higher pressure so that little, if any, pressure differential is created between the pump housing 129 and the tank interior which would draw liquid into the pump 128. The pump 128, therefore, typically does not prime while air flow is allowed in through the discharge outlet 56.

As the motor 93 continues to operate, liquid will continue to collect in the tank 32. As liquid collects in the tank 32 and the liquid level rises, liquid will enter into the liquid intake assembly 216. The liquid will flow through the screen 256 and into the hollow body defined by the upper housing piece 250 through the inlet opening. Liquid will then collect in the hollow body. When the liquid level in the hollow body reaches the inlet portion 231 of the inlet tube 214, the pump 128 is capable of self-priming. To prime the pump, the pinch valve member 174 is actuated to the closed position to cut off air flow through the discharge outlet 56. As a result, the pump housing 129 is reduced to the lower pressure generated at the interior impeller space 392 due to the air flow path between the interior impeller space 392 and the pump housing 129 described above. The reduced pressure creates a greater pressure differential between the pump housing 129 and the tank 32. The pump will prime when the low pressure in the pump housing 129 is sufficient to draw the liquid collecting at the inlet portion 231 of the fitting 230 up through the fitting 230, through the inlet tube 214, through the inlet stub tube 134 and into the pump housing 129, thereby priming the pump 128. The low pressure in the pump housing 129 will generally be lower than the pressure of the vacuum in the tank 32 as long as there is flow through the tank inlet 40.

Liquid flowing up into the pump housing 129, however, will not pass through the priming orifice 377 of the pump housing 129, and consequently will not enter the area of the air impeller 74 or the motor 93, due to a pressure created by rotation of the second set of impeller blades 390. As noted above, the outer diameter 372 of the second set of impeller blades 290 is preferably larger than the outer diameter 370 of the first set of impeller blades 288 to ensure that the pressure force produced by the second set is greater than that of the first set, thereby preventing fluid from leaking through the gap 378. In most situations, the pinch valve member 174 must be in the closed position to effect priming of the pump 128. Otherwise air from atmosphere will be pulled into the pump housing 129 from the discharge opening 56, thereby preventing the formation of a low pressure area in the pump housing 129.

From the pump housing 129, the liquid will be pumped into the pump outlet 130 and into the priming and discharge assembly 162. If the pinch valve member 174 is in the closed position, the liquid will back up behind the pinched sides of the flexible tube 170 and will not discharge from the vacuum cleaner 30 through the discharge opening 56. When the user desires to discharge liquid, however, the user may simply release the priming button 178 so that the pinch valve member 174 moves to the open position, allowing the vacuum cleaner 30 to discharge the pumped liquid through the discharge opening 56.

If, while vacuuming, the level of the liquid in the tank 32 gets too high, the mechanical shut-off and override assembly 150 will automatically shut-off the motor 93. When the liquid in the tank 32 gets to the level of the float 154, the liquid pushes the float 154 upward which pushes the float rod 152 upward. The collar 111 and inlet stub tube 134 guide the float 154 as it rises. Eventually, the rising liquid will push the float rod 152 high enough to turn the switch 151 "OFF" which stops the motor 93 and stops the air impeller 74 and the pump impeller 352 from rotating. The float 154 should be placed at a height low enough so that the motor 93 is turned "OFF" before the level of liquid is high enough to begin entering the air impeller 74. Once the motor 93 has been turned "OFF", the user, when in pumping mode, has two options: the user may either remove the upper vacuum assembly 34 and manually empty the tank 32 or the user may bypass the float shut-off by mechanically overriding the float shut-off. When the user is finished either vacuuming or pumping with the vacuum cleaner 30, the user turns the vacuum cleaner 30 "OFF" by pushing downward on the user engageable actuator 62.

The foregoing detailed description has been given for clearness of understanding only, and no unnecessary limitations should be understood therefrom, as modifications would be obvious to those skilled in the art.

What is claimed is:

1. A vacuum cleaner comprising:

a tank having an inlet for receiving liquid material, the tank defining an interior;

an air impeller housing having an opening in air flow communication with the tank interior;

a driven air impeller disposed inside the air impeller housing and defining an interior impeller space, the air impeller creating a low pressure area in the tank interior and a lower pressure area at the interior impeller space;

a pump housing having an inlet in fluid communication with the tank interior and an outlet;

a powered pump impeller disposed inside the pump housing;

outlet piping extending between the pump outlet and the tank exterior, the outlet piping including a flexible tube section; and a pinch valve positioned to engage the flexible tube section, the pinch valve moving between a first position allowing fluid flow through the tube section, and a second position, which prevents fluid flow through the tube section.

2. The vacuum cleaner of claim 1, in which the tank comprises an upper vacuum assembly defining a discharge outlet, and the outlet piping extends from the pump outlet to the discharge outlet.

3. The vacuum cleaner of claim 2, in which the upper vacuum assembly carries the air impeller housing, pump housing, outlet piping, and pinch valve.

4. The vacuum cleaner of claim 3, in which the upper vacuum assembly further comprises a priming button adapted to engage and actuate the pinch valve.

5. The vacuum cleaner of claim 4, further comprising an actuating arm extending between the priming button and the pinch valve.

6. The vacuum cleaner of claim 2, further comprising a cap removably attached to the discharge outlet.

7. The vacuum cleaner of claim 1, wherein:

when the pinch valve is in the first position, air flow into the pump outlet creates a relatively low pressure drop across the pump inlet; and when the pinch valve is in the second position, air flow into the pump outlet is decreased, thereby creating a relatively high pressure drop across the pump inlet to draw fluid from the tank into the pump housing to prime the pump.

8. A vacuum cleaner comprising:

a tank having an inlet for receiving liquid material, the tank defining an interior;

an upper vacuum assembly releasably attached to the tank, the upper vacuum assembly including a discharge outlet;

an air impeller housing carried by the upper vacuum assembly and having an opening in air flow communication with the tank interior;

a driven air impeller disposed inside the air impeller housing and defining an interior impeller space, the air impeller creating a low pressure area in the tank interior and a lower pressure area at the interior impeller space;

a pump housing carried by the upper vacuum assembly and having an inlet in fluid communication with the tank interior and an outlet;

a powered pump impeller disposed inside the pump housing;

a pump outlet pipe extending from the pump outlet to the discharge outlet, the pump outlet pipe remaining in place between the pump outlet and the discharge outlet when the upper vacuum assembly is removed from the tank; and a pump inlet assembly removably attached to the pump housing inlet, the pump inlet assembly establishing fluid communication between the pump housing inlet and the tank interior.

9. The vacuum cleaner of claim 8, in which the pump outlet pipe comprises a flexible tube.

10. The vacuum cleaner of claim 9, further comprising a pinch valve positioned to engage a portion of the flexible tube, the pinch valve moveable between a first position which allows fluid flow through the flexible tube and a second position which prevents flow through the flexible tube.

11. The vacuum cleaner of claim 8, further comprising a priming apparatus having a priming orifice formed in the pump housing and fluidly communicating with the interior impeller space.

12. A vacuum cleaner comprising:

a tank having an inlet for receiving liquid material, the tank defining an interior;

an upper vacuum assembly releasably attached to the tank, the upper vacuum assembly including a discharge outlet;

a lid cage carried by the upper vacuum assembly, the lid cage having a periphery having a filter receiving portion and a non-filter receiving portion;

an air impeller housing carried by the upper vacuum assembly and having an opening in air flow communication with the tank interior;

a driven air impeller disposed inside the air impeller housing and defining an interior impeller space, the air impeller creating a low pressure area in the tank interior and a lower pressure area at the interior impeller space;

a pump housing carried by the upper vacuum assembly and having an inlet in fluid communication with the tank interior and an outlet disposed inside the lid cage;

a powered pump impeller disposed inside the pump housing; and a pump outlet pipe extending from the pump outlet to the discharge outlet, the pump outlet pipe passing through the non-filter receiving portion of the lid cage.

13. The vacuum cleaner of claim 12, in which the pump outlet pipe comprises a flexible tube.

14. The vacuum cleaner of claim 13, further comprising a pinch valve positioned to engage a portion of the flexible tube, the pinch valve moveable between a first position which allows fluid flow through the flexible tube and a second position which prevents flow through the flexible tube.

15. The vacuum cleaner of claim 12, in which the air impeller housing defines an interior impeller space having a lower pressure than the tank interior, and the priming apparatus comprises a priming orifice formed in the pump housing and fluidly communicating with the interior impeller space.

16. A vacuum cleaner comprising:

a tank having an inlet for receiving liquid material, the tank defining an interior;

an air impeller housing having an inlet in air flow communication with the tank interior;

an air impeller disposed inside the air impeller housing;

a motor for driving the air impeller;

a switch operably coupled to the motor;

a center tube disposed inside the tank;

a float having a guide extension portion sized to slidably engage an exterior of the center tube, and a liquid engaging portion, the float positioned inside the tank so that the guide extension portion is disposed about the center tube; and a float rod extending from the float to the switch;

wherein the float slides upwardly along the center tube as the liquid collects in the tank thereby to actuate the switch via the float rod.

17. The vacuum cleaner of claim 16, further comprising a pump disposed inside the tank, in which the center tube comprises an inlet stub tube of the pump.

18. The vacuum cleaner of claim 17, further comprising an inlet tube assembly having an inlet tube attached to the inlet stub tube, in which the liquid engaging portion has a generally annular shape extending around the inlet tube.

19. The vacuum cleaner of claim 16, further comprising a lid cage disposed inside the tank and having a bottom plate, in which the float is disposed inside the lid cage so that the liquid engaging portion rests on the bottom plate.

20. The vacuum cleaner of claim 19, in which the bottom plate includes a collar, and in which the float further comprises an inner sleeve sized for insertion over the collar, so that the collar and inlet stub tube guide the float as the float slides upwards.

* * * * *